US007772495B2

(12) United States Patent
Wu et al.

(10) Patent No.: US 7,772,495 B2
(45) Date of Patent: Aug. 10, 2010

(54) WIRE CABLE WITH SAVING ENERGY

(76) Inventors: Jeng-Shyong Wu, No. 14, Alley 1, Lane 326, Shyr-Pin Road, Hsin-Chu City (TW); Li-Wen Liu, No. 80, Section 4, Yan-Ping North Road, Taipei (TW); Woi-Jen Liu, No. 80, Section 4, Yan-Ping North Road, Taipei (TW)

( * ) Notice: Subject to any disclaimer, the term of this patent is extended or adjusted under 35 U.S.C. 154(b) by 0 days.

(21) Appl. No.: 12/349,162

(22) Filed: Jan. 6, 2009

(65) Prior Publication Data

US 2009/0178825 A1 Jul. 16, 2009

(51) Int. Cl.
*H01B 7/00* (2006.01)

(52) U.S. Cl. ..... 174/113 R; 174/113 C; 174/74 R

(58) Field of Classification Search ..... 174/110 R, 174/113 R, 113 C, 74 R, 74 A, 84 R, 84 C
See application file for complete search history.

(56) References Cited

U.S. PATENT DOCUMENTS 2,081,634 A * 5/1937 McNamee ..... 174/115
2,804,494 A * 8/1957 Fenton ..... 174/113 AS
4,135,056 A * 1/1979 Seguin ..... 174/113 C
4,600,268 A * 7/1986 Spicer ..... 385/103
4,767,890 A * 8/1988 Magnan ..... 174/28
4,795,380 A * 1/1989 Frantz ..... 439/860
5,519,173 A * 5/1996 Newmoyer et al. ..... 174/113 R
6,259,031 B1 * 7/2001 Totland et al. ..... 174/110 R
6,303,867 B1 * 10/2001 Clark et al. ..... 174/113 R
6,713,673 B2 * 3/2004 Kao ..... 174/36
6,833,506 B2 * 12/2004 Wechsler ..... 174/113 R
2005/0087360 A1 * 4/2005 Speer ..... 174/113 C

* cited by examiner

*Primary Examiner*—William H Mayo, III
(74) *Attorney, Agent, or Firm*—McGlew and Tuttle, P.C.

(57) ABSTRACT

A wire cable of electric conductor forming of multiple metals or alloys includes single (bundle) wire cable or double (bundle) wire cables, in which at least in one bundle of electric conductor, each bundle of electric conductor is composed of slim electric wire made by two or more than two metals or alloys, which is covered by insulator to form a wire cable of electric conductor.

20 Claims, 8 Drawing Sheets

WIRE CABLE WITH SAVING ENERGY

BACKGROUND OF INVENTION

1. Field of Invention

The present invention relates to a kind of wire cable with saving energy of electric conductor. Especially, it relates to a wire cable of electric conductor able to increase the effect of transportation of electricity and decrease (down low) the producing costs to protect the safety of the users.

2. Description of Prior Art

Owing to the demand of human being increasing, the natural souses in the earth are instantly and quickly consumptive. The resolving ways are positive to recovery the usable souse and restrict the assumption of the various naturally souses. In the modern human beings living, the electricity is extremely important. However, the transportations of electricity demand a large quantity of the metals of copper, aluminum, etc. Thus, if we can not influence the transportation of electricity, the quantity of the above mentioned metals of copper, aluminum, etc. can be decreased. It is nature to reach multiple effects of decreasing of the assumption of souses and also decreasing producing costs so as to increase the economical effects.

According to the handbook of World Electric Engineering Handbook and under general situation, insulated PVC wire cable able to durable 600V of Φ1.6 mm (cross section area 2 $mm^2$), their safe electric current is 20 ampere. That is the cross section area of each 1 $mm^2$ able to transport electric current of 10 ampere. Obviously, the efficiency of the transportations of electricity of the metal wire cable with larger cross section area is worse. Thus, it is the topic for the related entrepreneur urgently to endeavour diligently, how to increase the efficiency of the transportations of electricity of the metal wire cable with large cross section area and to decrease the use of large quantity of the metals of copper, aluminum.

SUMMARY OF THE INVENTION

Concerning the traditional metal wire cable having the above-mentioned shortcoming, the present invention provides an improvement method in view of these shortcomings. Therefore, the purpose of the present invention is to provide a kind of wire cable with saving energy of electric conductor, which is completely to use the skin effect of metal wire cable so as to increase the quantity and efficiency of transportations of electricity of metal wire cable.

The further purpose of the present invention is to provide wire cable with saving energy of electric conductor. It is able to save the consumption of a large quantity of the metals of copper, aluminum, etc. so as to reduce the production cost effectively and to save natural resources.

Another purpose of the present invention is to provide wire cable with saving energy of electric conductor, by means of ventilating to cool the metal to resist the heat of electrifying, so as to effectively low down the temperature of wire cable while using.

In order to achieve the above mentioned purposes, the present invention provides a kind of wire cable with saving energy of electric conductor comprising: multiple conductors, at least support body (element) along with axial direction to support said wire conductor, an insulator to cover the wire conductor and support body.

Other objects, effects and features will become apparent when the description of preferred embodiments is taken in conjunction with the annexed drawings.

DETAILED DESCRIPTION OF THE INVENTION

Figure 1:
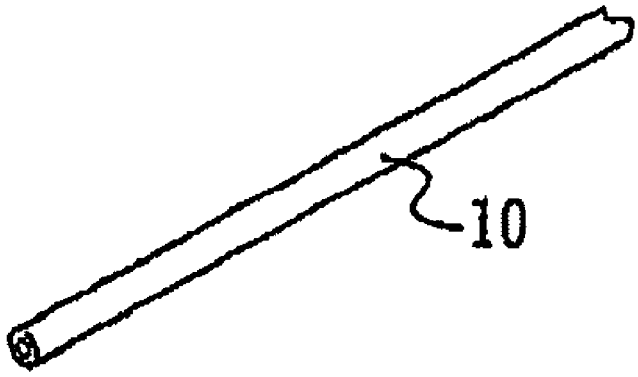
FIG. 1 is perspective view of a structure of the wire conductor with a principle hollow circle pipe of the present invention.
Figure 2:
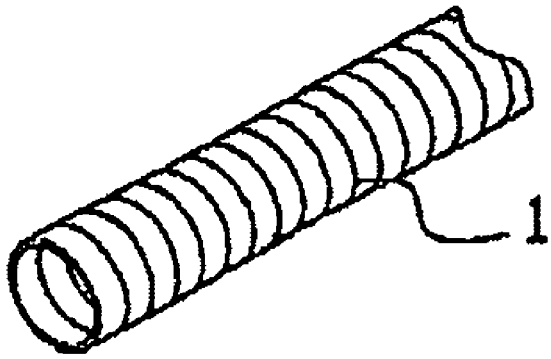
FIG. 2 is perspective view of a screw structure of the wire conductor with a principle hollow circle pipe of the present invention.
Figure 3:
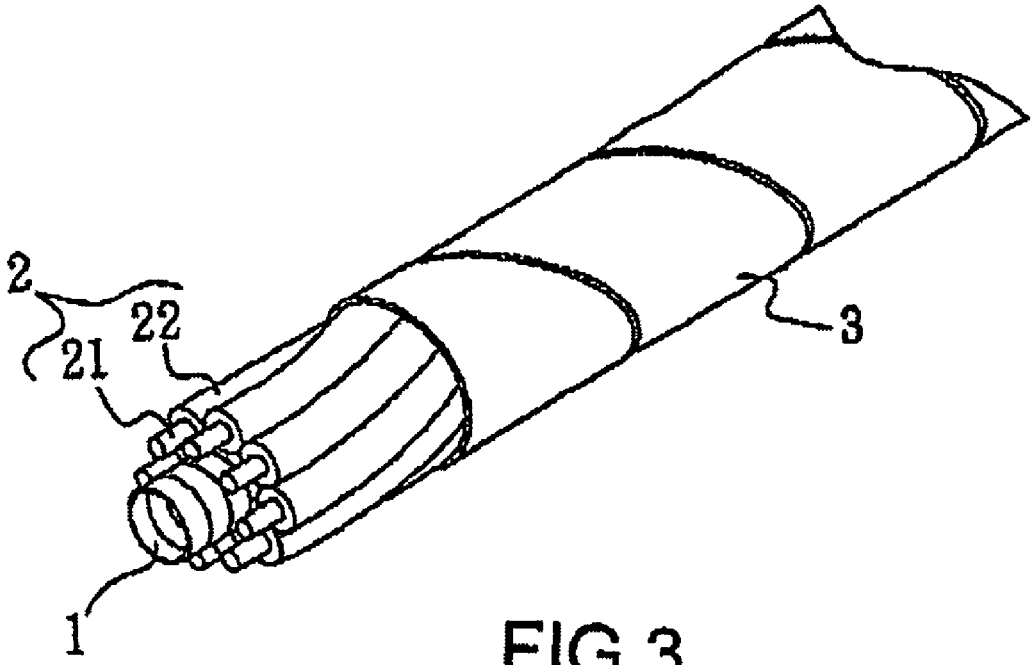
FIG. 3 is perspective view of the structure of the first aspect of the first embodiment of the present invention.
Figure 4:
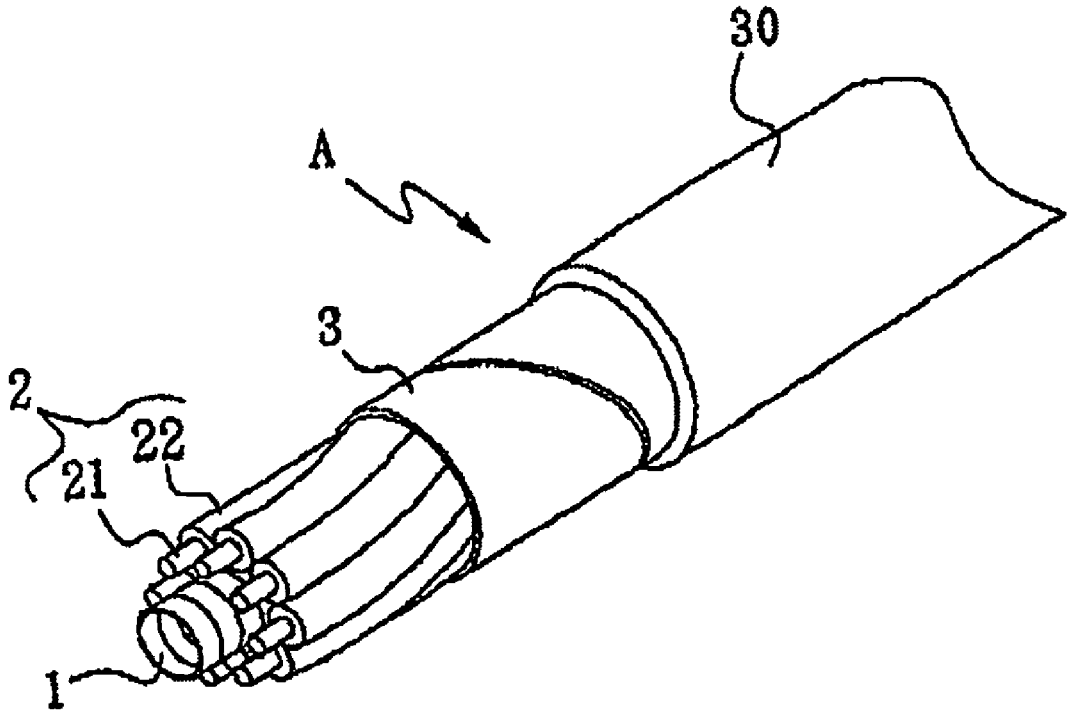
FIG. 4 is perspective view of the structure of the second aspect of the first embodiment of the present invention.
Figure 5:
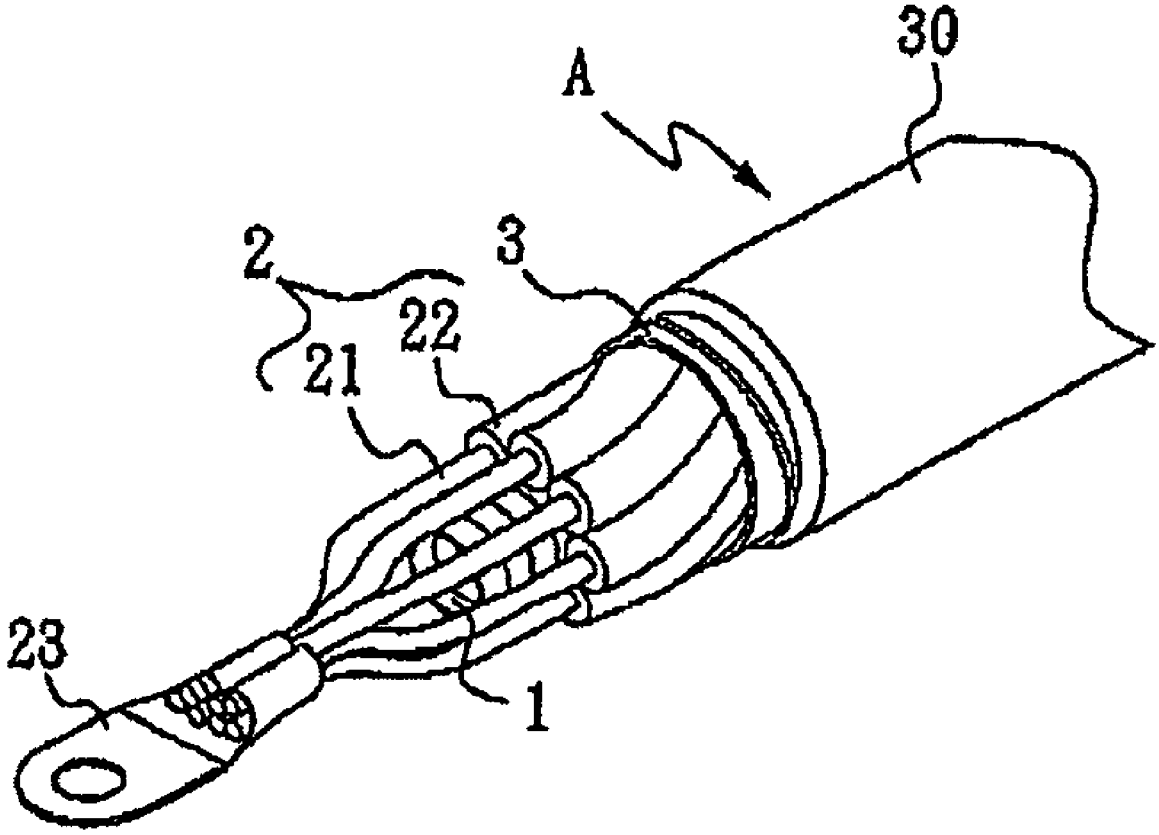
FIG. 5 is perspective view of the combination of the first embodiment with the terminal of electric conductor of the present invention.

Now referring to FIGS. 1 to 5, these drawings show the structure of embodiment one mainly comprising insulator, hollow pipe with flame-retardant made of flexible material, said hollow pipe can be a round hollow pipe 10 or a sectional flexible pipe 1 or a screw hollow pipe (not shown). While performance (practicing), the conductor 2 is axial direction along with the horizontally direction of the sectional flexible hollow pipe 1 (or round hollow pipe 10) so as to be arranged in order at the outside of the sectional flexible hollow pipe 1 (or round hollow pipe 10), or these conductors are axial direction by means of screw type along with the horizontally direction of the screw hollow pipe whereby to be arranged in order at the outside of the sectional flexible hollow pipe. Each conductor 2 can be a single core conductor or multiple conductors. It also can be produced by conducting material of copper alumina or alloy. The structure of each conductor 2 is a metal conductor 21 covered with an insulator layer 22. Each metal conductor 21 is not to contact each other to keep insulating by means of said insulator layer 22. Further, the outside of each conductor 2 is winding together with an insulating belt 3 (as shown in FIG. 3). According to the demand of insulating or protection, the outer circumference of said insulating belt 3 is equipped with another insulator 30 (as shown in FIG. 4), so as to form a unit of cable wire A. Finally, the exposed terminal of the metal conductor 21 of each conductor 2 can be compressing or welding connection to connect to a connector 23, whereby to favor the unit of cable wire A to connect to the outside. Taking advantage of sectional flexible hollow pipe 1, or round hollow pipe 10, or screw hollow pipe, the center of each conductor 2 keeps hollowing out with ventilating space, it is convenient to cool metal impedance in electric conduction occurring the heat, so as to reduce the temperature while using. Further, by means of the metal conductor 21 of each conductor 2 not to contact each other, it is able to take advantage of the skin effect of electric conduction, whereby to enhance the power output and transmission efficiency of the unit of cable wire A.

Figure 6:
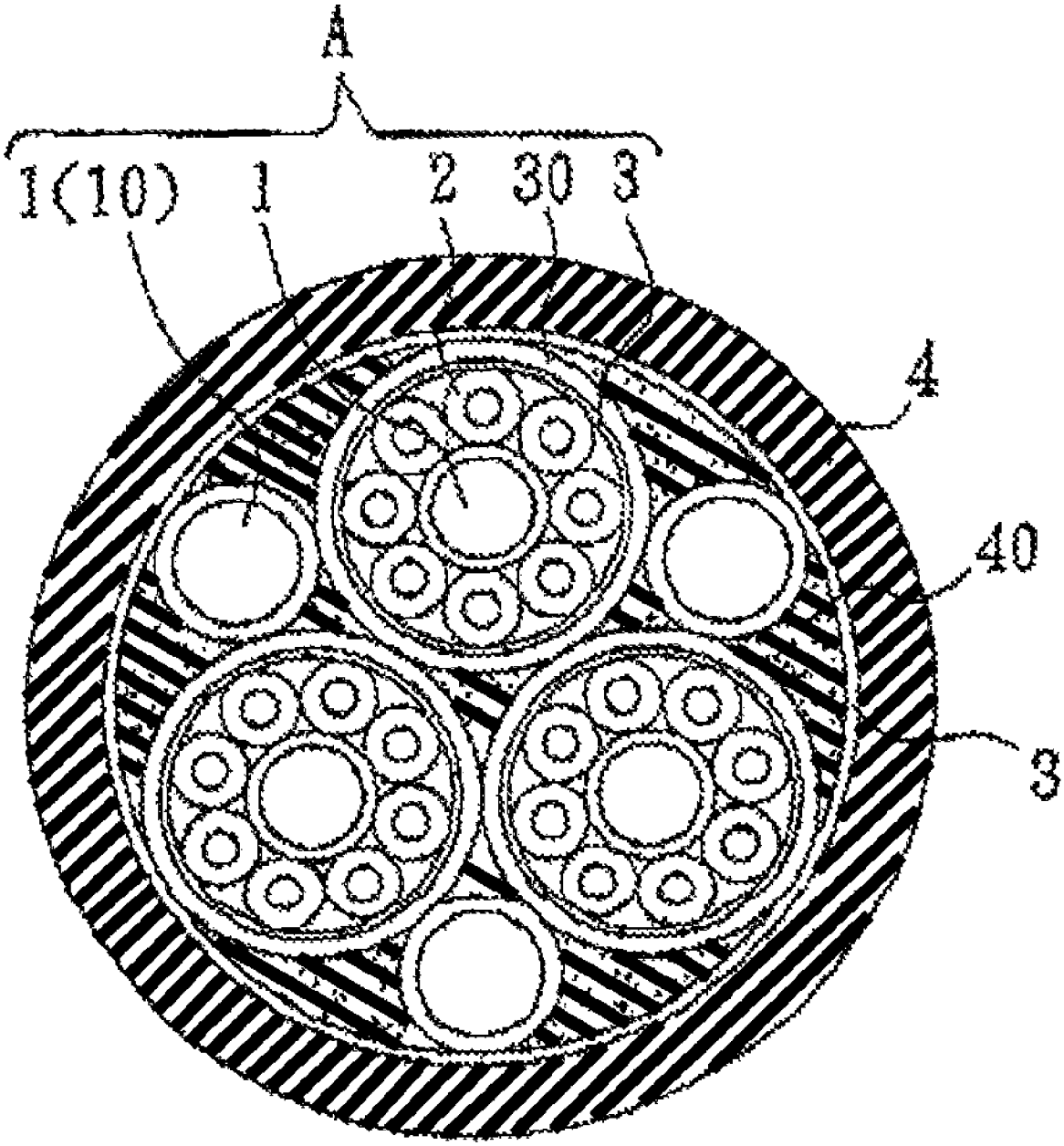
FIG. 6 is a cross sectional view of the structure of the first embodiment of the present invention.
Figure 7:
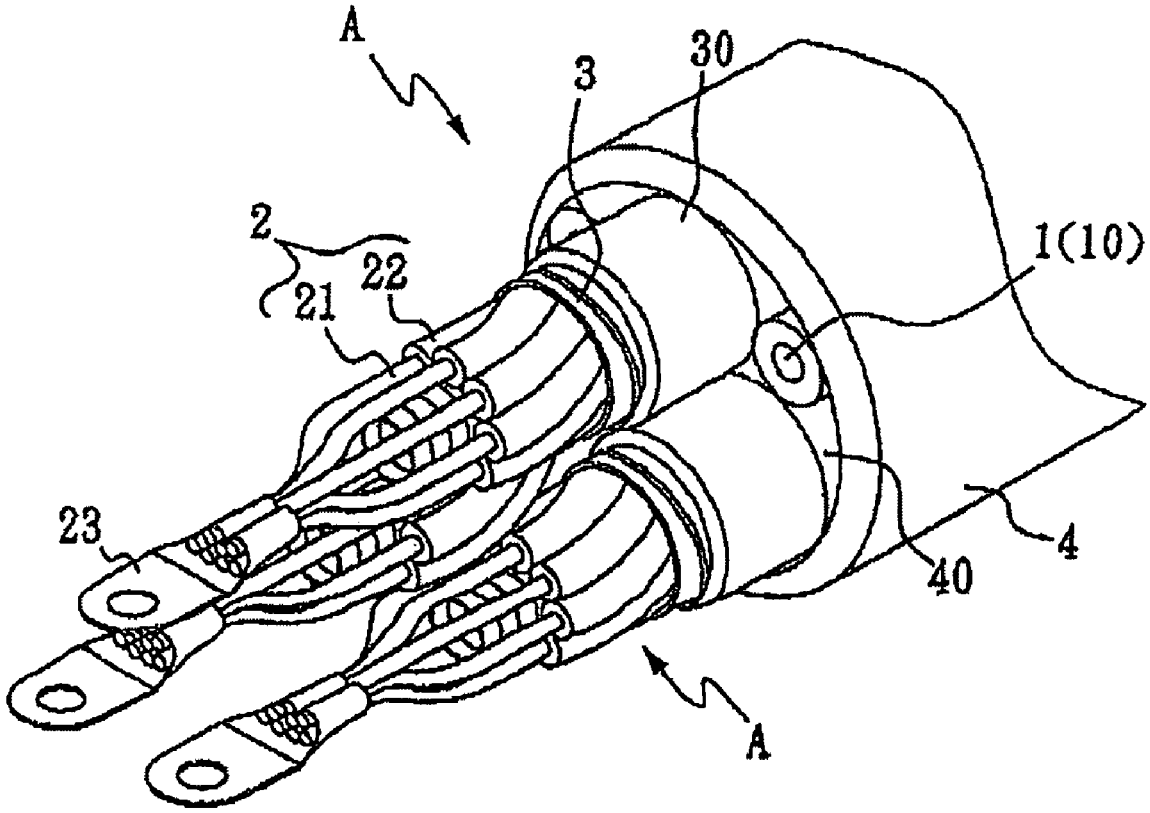
FIG. 7 is perspective view of the combination of the second embodiment with the terminal of electric conductor of the present invention.

FIG. 6 and FIG. 7 are the structures and performances of the second embodiment. As shown from each drawing, it is known that the structure of the second embodiment is based on the first embodiment. It is to take advantage of multiple cable wire A to line up in order with neighboring, and between each multiple cable wire A, a flexible hollow pipe and insulated filler 40 are equipped, such pipe can be sectional flexible hollow pipe 1, round hollow pipe 10 or screw hollow pipe, then the most outside flank equipped with together sheathing 4, finally the terminals of unit of cable wire A, i.e. the exposed terminal of metal conductor 21 of each conductor 2, are connected to the connector 23 so as to form a bigger structure of cable wire with electric conduction quantity.

Figure 8:
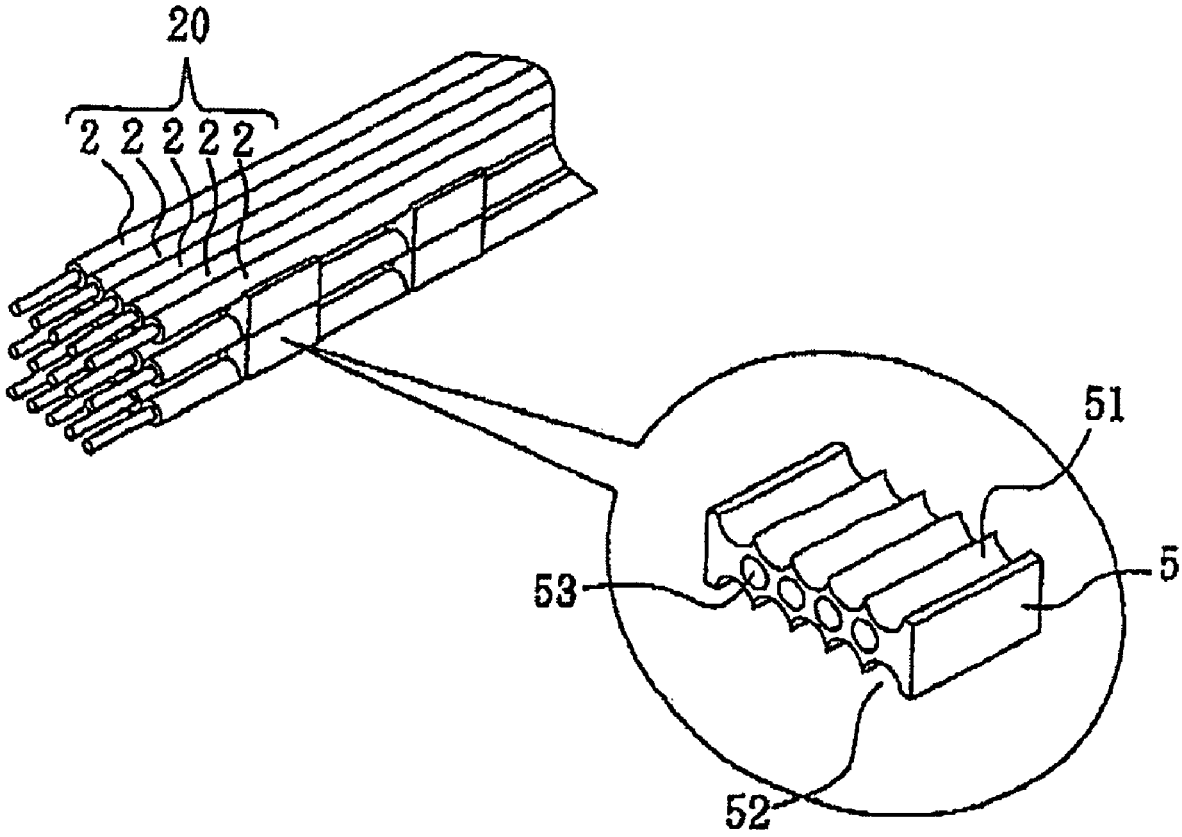
FIG. 8 is perspective view of the third embodiment of the present invention.
Figure 9:
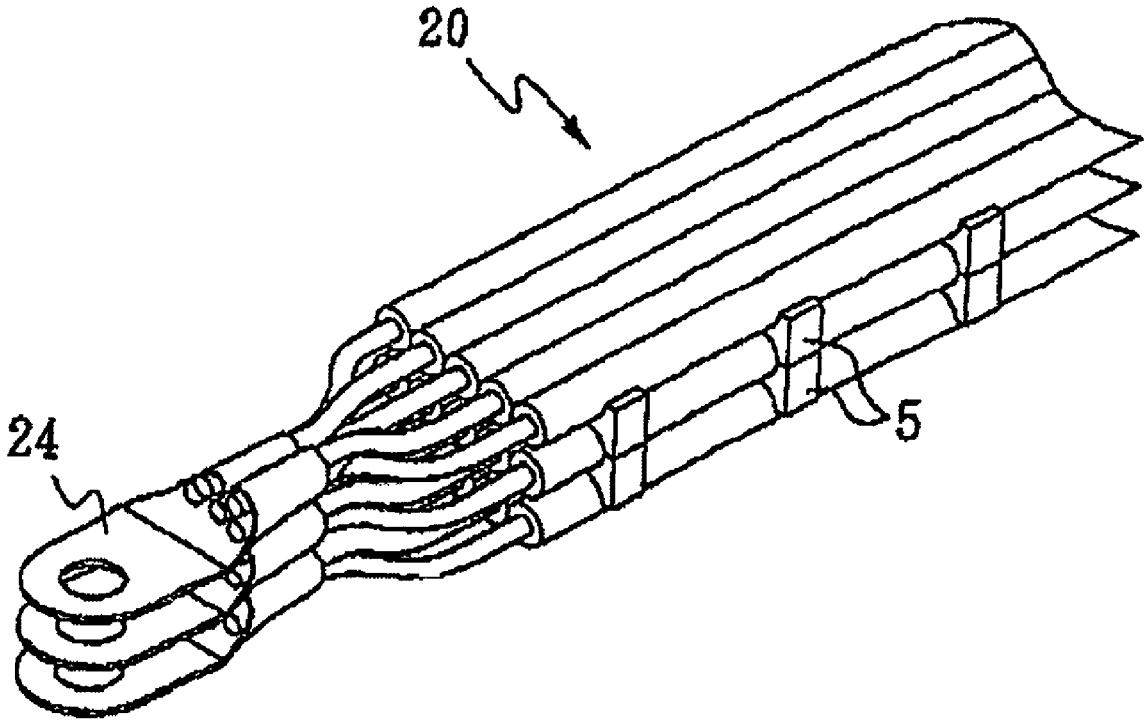
FIG. 9 is perspective view of the combination of the third embodiment with the terminal of electric conductor of the present invention.

FIG. 8 and FIG. 9 are the structures and performances of the third embodiment. As shown from each drawing, it is known that the structure of the third embodiment is mainly the multiple conductors 2 lined up with single layer to form a conductor set 20 and between each conductor set 20 equipped with flat-belt shaped body 5. At both side of the top and bottom of the flat-belt shaped body 5, multiple sinking grooves 51, 52 are arranged and are able to match the outer peripheral shape and arrangement density of conductor 2 to clip and fix each layer of conductor set 20 respectively, so that between each layer of conductor set 20, a appropriate distance is kept. Simultaneously, further multiple slit fin 53 are horizontally arranged at the center section of flat-belt shaped body 5 and the extending direction of said multiple slit fin 53 is same as that of conductor set 20 to penetrate the flat-belt shaped body 5. Said multiple slit fin 53 are able to promote the air circulation effect. Finally, the terminal part of conductor set 20 (i.e. the exposed part of metal conductor 21 of the conductor 2) can be connected to connector post 24 so as to form another cable wire set structure more larger.

Figure 10:
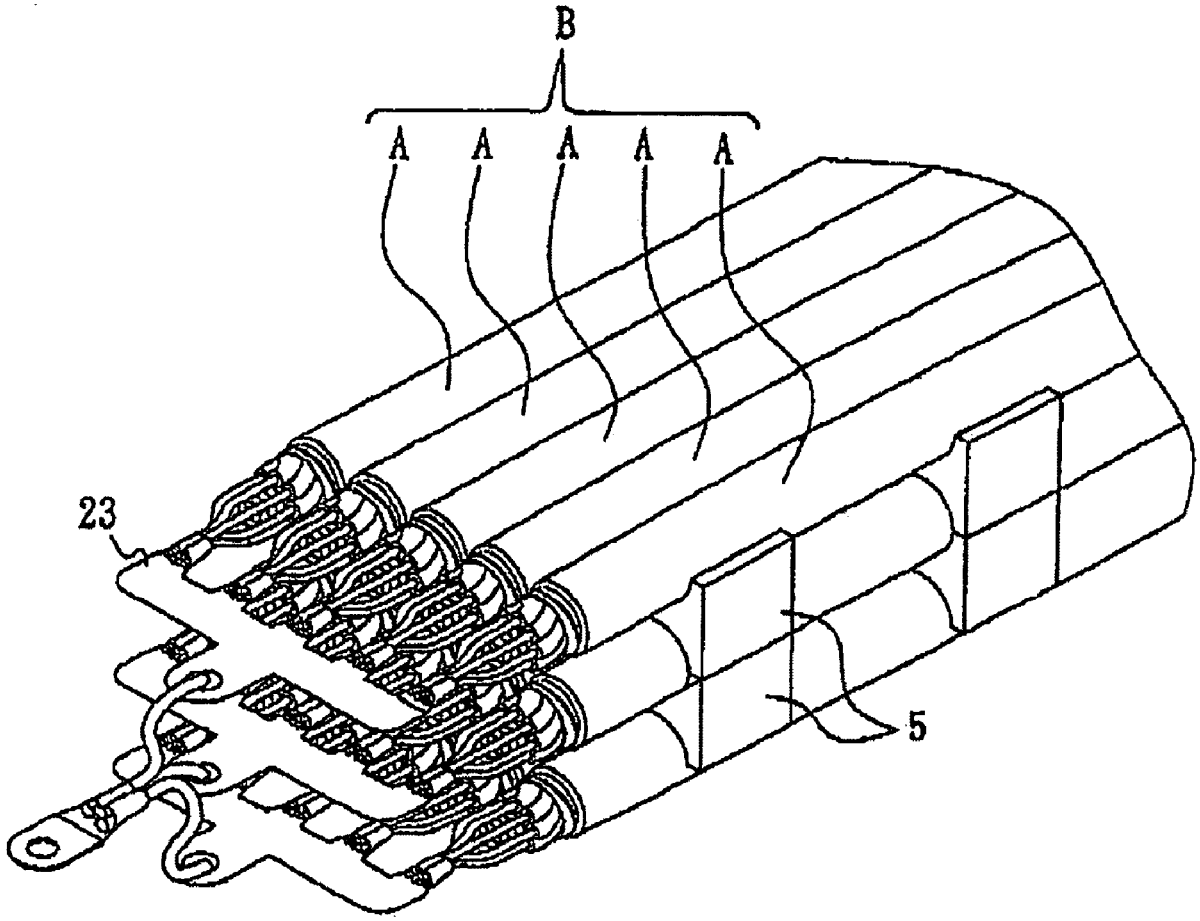
FIG. 10 is perspective view of the combination of the fourth embodiment with the terminal of electric conductor of the present invention.

FIG. 10 is perspective view of the combination of the fourth embodiment with the terminal of electric conductor of the present invention. As shown in the drawing, it is well known that the structure of the fourth embodiment is based on that of the first and the third embodiments. It is to take advantage of multiple cable wire A in single layer parallel arrangement to form a cable wire set B. Further, the same structure of flat-belt shaped body 5 is arranged between each cable wire set B (the structure and arrangement of flat-belt shaped body 5 are same as mentioned above). The terminal of each unit of cable wire A can be connected to connector post 23 so as to form another cable wire set structure with electric conduction quantity larger than that of mentioned above in the third embodiment.

The structures mentioned in the above embodiments of the present invention are fully to take advantage of the skin effect of each metal conductor 21, Simultaneously, said structures equip with hollow and ventilating (sectional flexible hollow pipe 1, round hollow pipe 10, screw hollow pipe and slit fin 53) to cool down the heat formed by the metal. If it is able to limit the temperature not exceeding 40° C., it will increase the transportation electric quantity massively and effectively (owing to the electric transportation and because of metal impudence, the pass of electric current is able to generate heat. The more electric power, the more resistance, the generation heat is increasing accordingly. Owing to the heat in the conductor being not removed and for safety, it is to limit the temperature not exceeding 40° C. so that the transportation electric quantity can be massively. A big area of metal conductor with 500 $mm^2$ is done, for example, their safe electric current is 500 ampere inferior to the small area. The safe electric current benefit of metal conductor with 2 $mm^2$ is high up to 20 ampere. In case, the peripheral of the round flexible pipe is encircled by several insulated single core conductor 2 with 2 $mm^2$, or several layers with parallel of insulated conductor 2 are separated a suitable distance respectively whereby to have a good radiation function, under the safe electric current load standard, it is able to several insulated conductor 2 compressed and weld into a connector 23 or 24, i.e. the total sum of transportation electric current of each insulated conductor 2. Therefore, it is effective to save wire material of copper/alumina so as to increase the electric transmission power. In case, a painted electric wire or wire enveloped by paint and covered with a slim plastic is used as conductor, it can reduce the electric wire outer diameter and save insulated material, further it is advantageous for the process of construction. For example: the formation of the traditional 500 $mm^2$ is to use 61 copper wire with Φ3.2 mm, the weight is 4448 Kg per 1000 meter, the safe electric current is 500 ampere. However, the construction of the present invention is to use 25 copper wire with Φ1.6 mm, the safe electric current is also 500 ampere, the weight is 447 Kg per 1000 meter. The load current of the present invention and the tradition one is the same, but in comparison with the present invention and the traditional one, the present invention can save the copper material of 4000 Kg. The benefit is astonishing. Take copper wire with Φ1.6 mm as the example, if is substituted by alumina wire, it is able to increase the cross-section up to 30%. Even the single wire with Φ1.83 mm diameter used, it is still able to transport the safe electric current with 20 ampere. The alumina wire is used to transport electric power with 500 ampere and it is only to use 25 alumina wire with Φ1.83 mm, their weight is 235 Kg per 1000 meter. It is outstanding benefit to save the copper and alumina sources.

The present invention of wire cable with saving energy is able to reduce the production cost, to increase the transportation electric power efficiency and to decrease the temperature increasing effect. The present invention is with the originality and progressive. From the foregoing, it will be appreciated that although the specific embodiments of the invention have been described herein for purposed of illustration, various modifications and improvements thereon will become readily apparent to those skilled in the art. Accordingly, the appended claims are to be construed broadly and in a manner consistent with the spirit and scope of the invention described herein.

DESCIPTION OF SYMBOLS

1 sectional flexible hollow pipe
10 round flexible pipe
2 conductor
20 conductor set
21 metal conductor
22 insulated layer
23 connector post
24 connector post
3 insulating belt
30 insulator
4 sheathing
40 insulated filler
5 flat-belt shaped body
51 sinking grooves
52 sinking grooves
53 slit fin
A unit of cable wire
B cable wire set

What is claimed is:

1. An electric cable comprising:

a support body having an axial length and a cross sectional length, said axial length being larger than said cross-sectional length, said support body having an exterior surface and defining a hollow interior;

a plurality of conductors arranged axially along said exterior surface of said support body, each of said plurality of conductors including a metal conducting portion circumferentially surrounded by an insulating layer;

another insulating layer circumferentially surrounding all of said plurality of conductors and said support body;

a connector post arranged at an axial end of said support body, all of said metal conducting portions of said plurality of conductors being electrically connected to said connector post.

2. A cable as claimed in claim 1, wherein said support body is a round hollow pipe, wherein said conductors are in an axial direction along an axial direction of the round hollow pipe so as to be arranged in order outside said round hollow pipe.

3. An electric cable in accordance with claim 1, wherein:

said metal conducting portions of said plurality of conductor extend beyond said axial end of said support body.

4. An electric cable in accordance with claim 1, wherein:

each of said plurality of conductors lie flat on said exterior surface and are not twisted about another one of said plurality of conductors.

5. An electric cable in accordance with claim 1, wherein:

said plurality of conductors lie directly adjacent said exterior surface of said support body for an entire said axial length of said support body.

6. An electric cable in accordance with claim 1, wherein:

each of said plurality of conductors are directly adjacent a same two of said plurality of conductors over said entire axial length of said support body.

7. An electric cable in accordance with claim 1, wherein:

said support body has a circular cross sectional shape.

8. An electric cable in accordance with claim 1, wherein:

said support body has an overall general polygonal cross sectional shape;

a first group of said plurality of conductors being arranged in a plane along a first side of said support body, a second group of said plurality of conductors being arranged in a plane along a second side of said support body.

9. An electric cable in accordance with claim 8, wherein:

said support body defines a plurality of sinking grooves to receive said plurality of conductors.

10. An electric cable in accordance with claim 1, wherein:

said hollow interior of said support body is a passage for removing heat generated in said metal conducting portions of said plurality of conductors.

11. An electric cable in accordance with claim 1, wherein:

said support body is flexible.

12. An electric cable in accordance with claim 1, further comprising:

insulating material completely filling a spaced between said support body and said plurality of conductors.

13. An electric cable comprising:

a support body having an axial length and a cross sectional length, said axial length being larger than said cross-sectional length, said support body having an exterior surface and defining a hollow interior;

a plurality of conductors arranged axially along said exterior surface of said support body, each of said plurality of conductors including a metal conducting portion circumferentially surrounded by an insulating layer, said plurality of conductors lying directly adjacent said exterior surface for an entire said axial length of said support body;

another insulating layer circumferentially surrounding all of said plurality of conductors and said support body.

14. An electric cable in accordance with claim 13, further comprising:

a connector post arranged at an axial end of said support body, all of said metal conducting portions of said plurality of conductors being electrically connected to said connector post.

15. An electric cable in accordance with claim 14, wherein:

said metal conducting portions of said plurality of conductor extend beyond said axial end of said support body.

16. An electric cable in accordance with claim 14, wherein:

each of said plurality of conductors lie flat on said exterior surface of said support body and are not twisted about another one of said plurality of conductors.

17. An electric cable in accordance with claim 14, wherein:

said metal conducting portions of said plurality of conductor extend beyond said axial end of said support body;

each of said plurality of conductors lie flat on said exterior surface of said support body and are not twisted about another one of said plurality of conductors;

each of said plurality of conductors are directly adjacent a same two of said plurality of conductors over said entire axial length of said support body said hollow interior of said support body is a gas passage for removing heat generated in said metal conducting portions of said plurality of conductors said support body is flexible;

insulating material completely fills a spaced between said support body and said plurality of conductors.

18. An electric cable in accordance with claim 13, wherein:

each of said plurality of conductors are directly adjacent a same two of said plurality of conductors over said entire axial length of said support body.

19. An electric cable in accordance with claim 13, wherein:

said hollow interior of said support body is a passage for removing heat generated in said metal conducting portions of said plurality of conductors.

20. An electric cable in accordance with claim 13, wherein:

said support body is flexible.

* * * * *